US011519245B2

(12) United States Patent
Dusterhoft et al.

(10) Patent No.: US 11,519,245 B2
(45) Date of Patent: Dec. 6, 2022

(54) WELL INTERVENTION-LESS CONTROL OF PERFORATION FORMATION AND ISOLATION

(71) Applicant: HALLIBURTON ENERGY SERVICES, INC., Houston, TX (US)

(72) Inventors: Ronald Glen Dusterhoft, Katy, TX (US); Etienne M. Samson, Cypress, TX (US); James Marshall Barker, Mansfield, TX (US); Ubong Inyang, Humble, TX (US); William Owen Alexander Ruhle, Denver, CO (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 41 days.

(21) Appl. No.: 16/869,260

(22) Filed: May 7, 2020

(65) Prior Publication Data

US 2021/0348484 A1 Nov. 11, 2021

(51) Int. Cl.

| | |
|---|---|
| ***E21B 43/11*** | (2006.01) |
| ***E21B 43/26*** | (2006.01) |
| ***E21B 33/124*** | (2006.01) |
| ***E21B 47/00*** | (2012.01) |
| ***E21B 47/14*** | (2006.01) |
| ***E21B 33/138*** | (2006.01) |
| ***E21B 47/13*** | (2012.01) |

(Continued)

(52) U.S. Cl.

CPC ..... *E21B 43/11* (2013.01); *E21B 33/124* (2013.01); *E21B 33/138* (2013.01); *E21B 43/26* (2013.01); *E21B 47/00* (2013.01); *E21B 47/13* (2020.05); *E21B 47/14* (2013.01); *E21B 43/267* (2013.01); *E21B 47/06* (2013.01)

(58) Field of Classification Search

CPC ..... E21B 43/11; E21B 47/14; E21B 47/13; E21B 43/26; E21B 43/2605; E21B 43/2607; E21B 43/27; E21B 33/124

See application file for complete search history.

(56) References Cited

U.S. PATENT DOCUMENTS

| | | | | |
|---|---|---|---|---|
| 6,536,524 | B1 | 3/2003 | Snider | |
| 6,543,538 | B2 * | 4/2003 | Tolman | E21B 43/116 166/284 |

(Continued)

OTHER PUBLICATIONS

International Search Report, Response and Written Opinion, PCT Application No. PCT/US2020/037395, dated Jan. 29, 2021.

*Primary Examiner* — Catherine Loikith

(74) *Attorney, Agent, or Firm* — Novak Druce Carroll LLP

(57) ABSTRACT

Aspects of the subject technology relate to systems and methods for controlling a hydraulic fracturing job. One or more perforations to create during a fracturing stage of a fracturing job at one or more corresponding perforation sites in a wellbore can be identified. The one or more perforations can be formed through one or more perforation devices disposed in the wellbore. Specifically, the one or more perforation devices can be selectively activated from a surface of the wellbore through a well intervention-less technique to selectively form the one or more perforations during the fracturing stage. Further, a volume of fracturing fluid can be pumped into the wellbore during the fracturing stage to form one or more first fractures in a surrounding formation through the one or more perforations.

20 Claims, 8 Drawing Sheets

(51) Int. Cl.
*E21B 47/06* (2012.01)
*E21B 43/267* (2006.01)

(56) References Cited

U.S. PATENT DOCUMENTS

| | | | | |
|---|---|---|---|---|
| 6,644,844 | B2 | 11/2003 | Neal et al. | |
| 7,152,676 | B2 * | 12/2006 | Vella | E21B 43/116 166/250.14 |
| 7,273,102 | B2 | 9/2007 | Sheffield | |
| 7,461,580 | B2 | 12/2008 | Bell et al. | |
| 7,546,875 | B2 * | 6/2009 | Whitsitt | E21B 43/08 166/278 |
| 7,975,592 | B2 | 7/2011 | Bell et al. | |
| 9,441,479 | B2 * | 9/2016 | Froelich | E21B 47/16 |
| 2002/0007949 | A1 | 1/2002 | Tolman et al. | |
| 2003/0000703 | A1 | 1/2003 | Cernocky et al. | |
| 2005/0263286 | A1 | 12/2005 | Sheffield | |
| 2007/0193740 | A1 | 8/2007 | Quint | |
| 2008/0093074 | A1 * | 4/2008 | Henderson | E21B 47/18 166/297 |
| 2016/0076363 | A1 * | 3/2016 | Morrow | E21B 43/11 166/381 |
| 2020/0003033 | A1 | 1/2020 | Dusterhoft | |

* cited by examiner

WELL INTERVENTION-LESS CONTROL OF PERFORATION FORMATION AND ISOLATION

TECHNICAL FIELD

The present technology pertains to well intervention-less perforation formation and isolation for conducting a fracturing job, and in particular to activating perforation devices from a surface of a wellbore to generate perforations through a well intervention-less technique.

BACKGROUND

Operators at fracturing jobs typically use wireline techniques to create perforations. Further, operators typically use wireline techniques to place isolation plugs for isolating previously formed perforations and facilitate performance of operations during a subsequent fracturing stage. However, wireline techniques are costly from both a resource utilization perspective and a time perspective. Specifically, the process of feeding a plug to a desired location in a wellbore through a wireline, setting the plug, and then pulling the wireline out of the wellbore is costly from a both a resource utilization and time perspective. More specifically, wireline techniques can consume time that a fracturing crew could otherwise use to actually pump a fracturing job. For example, while the wireline is disposed in a wellbore, a fracturing treatment can not be pumped into that wellbore. Further, wireline techniques involve the use of additional equipment that increases overall operational costs for a fracturing job.

Additionally, using isolation plugs to separate regions of a wellbore from each other between different fracturing stages is problematic. Specifically, isolation plugs typically have to be drilled out from the wellbore during a production phase of the wellbore. This can increase production costs and production times during the production phase of the wellbore. Further, isolation plugs can leak after being disposed in the wellbore, thereby potentially causing damage downhole from the plug and potentially reducing the effectiveness of a treatment on planned perforations above the plug.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
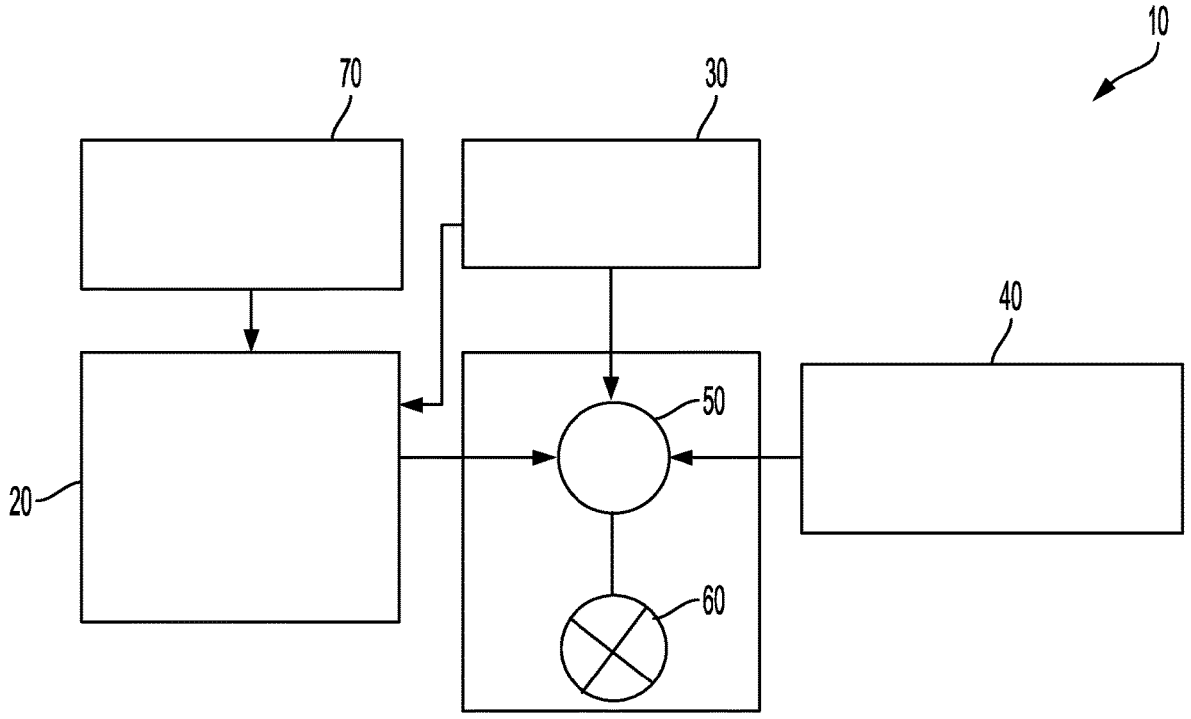
FIG. 1 is a schematic diagram of an example fracturing system, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Subterranean hydraulic fracturing is conducted to increase or "stimulate" production from a hydrocarbon well. To conduct a fracturing process, pressure is used to pump special fracturing fluids, including some that contain propping agents ("proppants"), down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally "prop-apart", or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production of hydrocarbons.

To begin a fracturing process, at least one perforation is made at a particular down-hole location through the well into a subterranean formation, e.g. through a wall of the well casing, to provide access to the formation for the fracturing fluid. The direction of the perforation attempts to determine at least the initial direction of the fracture.

A first "mini-fracture" test can be conducted in which a relatively small amount of proppant-free fracturing fluid is pumped into the formation to determine and/or confirm at least some of the properties of the formation, such as the permeability of the formation itself. Accurately knowing the permeability allows for a prediction of the fluid leak-off rate at various pressures, whereby the amount of fracturing fluid that will flow into the formation can be considered in establishing a pumping and proppant schedule. Thus, the total amount of fluid to be pumped down-hole is at least the sum of the hold-up of the well, the amount of fluid that fills the fracture, and the amount of fluid that leaks off into the formation, the formation matrix, microfractures, natural fractures, failed or otherwise sheared fractures, and/or bedding planes during the fracturing process itself. Leak-off rate is an important parameter because once proppant-laden fluid is pumped into the fracture, leak-off can increase the concentration of the proppant in the fracturing fluid beyond a target level. Data from the mini-fracture test then is usually used by experts to confirm or modify the original desired target profile of the fracture and the completion process used to achieve the fracture.

Fracturing then begins in earnest by first pumping proppant-free fluid into the wellbore or through tubing. The fracture is initiated and begins to grow in height, length, and/or width. This first proppant-free stage is usually called the "pre-pad" and consists of a low viscosity fluid. A second fluid pumping stage is usually then conducted of a different viscosity proppant-free fluid called the "pad." At a particular time in the pumping process, the proppant is then added to a fracturing and propping flow stream using a continuous blending process, and is usually gradually stepped-up in proppant concentration. The resultant fractures are then filled with a sufficient quantity of proppant to stabilize the fractures.

This process can be repeated in a plurality of fracturing stages to form a plurality of fractures through a wellbore, e.g. as part of a well completion phase. In particular and as will be discussed in greater detail later, this process can be repeatedly performed through a plug-and-perf technique to form the fractures throughout a subterranean formation. After the fractures are formed, resources, e.g. hydrocarbons, can be extracted from the fractures during a well production phase.

As discussed previously, operators at fracturing jobs typically use wireline techniques to create perforations. Further, operators typically use wireline techniques to place isolation plugs for isolating previously formed perforations and facilitate performance of operations during a subsequent fracturing stage. However, wireline techniques are costly from both a resource utilization perspective and a time perspective. Specifically, the process of feeding a plug to a desired location in a wellbore through a wireline, setting the plug, and then pulling the wireline out of the wellbore is costly from a both a resource utilization and time perspective. More specifically, wireline techniques can consume time that a fracturing crew could otherwise use to actually pump into a wellbore during a fracturing job. For example, while the wireline is disposed in a wellbore, a fracturing treatment generally cannot be pumped into the wellbore. A fracturing treatment, as used herein, can include pumping operations performed in actually forming and stabilizing fractures into a surrounding formation through perforations in a wellbore. Further, wireline techniques involve the use of additional equipment that increases overall operational costs for a fracturing job. There therefore exist needs for systems and methods for performing fracturing jobs without the use of wireline techniques. Specifically, there exist needs for system and methods for forming perforations during a fracturing job without the use of a wireline technique. Further, there exist needs for system and methods for isolating perforations during different fracturing stages of a fracturing job without the use of a wireline technique.

Additionally and as discussed previously, using isolation plugs to separate regions of a wellbore from each other between different fracturing stages is problematic. Specifically, isolation plugs typically have to be drilled out from the wellbore during a production phase of the wellbore. This can increase production costs and impact production times during the production phase of the wellbore. Further, isolation plugs can leak after being disposed in the wellbore, thereby potentially causing damage downhole from the plug and potentially reducing the effectiveness of a treatment on planned perforations above the plug. There therefore exist needs for systems and methods for isolating perforations during different fracturing stages of a fracturing job without the use of isolation plugs.

The disclosed technology addresses the foregoing by selectively activating perforation devices disposed in a wellbore through a well intervention-less technique. Specifically, perforation devices disposed in a wellbore can be activated from a surface of the wellbore through a well intervention-less technique to ultimately form perforations through a casing of the wellbore. In turn, this can reduce the amount of time and resources that would otherwise be used to form the perforations through a wireline technique. As follows, interruptions of pumping operations caused by using a wireline technique to create the perforations can be reduced or otherwise eliminated during a fracturing job. While reference is made throughout this disclosure to overcoming the deficiencies of a wireline technique, the systems and techniques described herein can be applied to overcoming similar deficiencies present in a coil tubing technique.

Further, the disclosed technology addresses the foregoing by isolating perforations in a wellbore during different fracturing stages of a fracturing job through a well intervention-less technique. Specifically, the perforations can be isolated from each other during the different fracturing stages without disposing one or more isolation plugs into the wellbore. In turn, this can reduce the amount of time and resources that would otherwise be used in disposing the isolation plugs, e.g. through a wireline technique, into the wellbore. As follows, interruptions of pumping operations caused by disposing the isolation plugs can be reduced or otherwise eliminated during the fracturing job. Further, this can eliminate or reduce production costs associated with removing isolation plugs from the wellbore during a production phase of the wellbore.

In various embodiments, a method can include identifying one or more perforations to create during a during a fracturing stage of a fracturing job at one or more corresponding perforation sites in a wellbore through one or more perforation devices disposed in the wellbore. The one or more perforation devices can be selectively activated from a surface of the wellbore through a well intervention-less technique to selectively form the one or more perforations during the fracturing stage. The method can also include pumping a volume of fracturing fluid into the wellbore during the fracturing stage to form one or more fractures in a surrounding formation through the one or more perforations.

In certain embodiments, a system can include a plurality of perforation devices disposed in a wellbore at specific perforation sites of a plurality of perforation sites. The system can also include a surface control system implemented, at least in part, at a surface of the wellbore. The surface control system can be configured to identify one or more perforations to create during a fracturing stage of a fracturing job at one or more corresponding perforation sites of the plurality of perforation sites in the wellbore through one or more corresponding perforation devices of the plurality of perforation devices. Further, the surface control system can be configured to selectively activate the one or more perforation devices from the surface of the wellbore through a well intervention-less technique to selectively form the one or more perforations during the fracturing stage. The one or more perforation devices can be selectively activated before a volume of fracturing fluid is pumped into the wellbore during the fracturing stage to form one or more fractures in a surrounding formation through the one or more perforations.

In various embodiments, a system can include a non-transitory computer-readable storage medium having stored therein instructions which, when executed by one or more processors, cause the one or more processors to identify one or more perforations to create during a fracturing stage of a fracturing job at one or more corresponding perforation sites in a wellbore through one or more perforation devices disposed in the wellbore. Further, the instructions can cause the one or more processors to selectively activate the one or more perforation devices from a surface of the wellbore through a well intervention-less technique to selectively form the one or more perforations during the fracturing stage. The one or more perforation devices can be selectively activated before a volume of fracturing fluid is pumped into the wellbore during the fracturing stage to form one or more fractures in a surrounding formation through the one or more perforations.

Turning now to FIG. 1, an example fracturing system 10 is shown. The example fracturing system 10 shown in FIG. 1 can be implemented using the systems, methods, and techniques described herein. In particular, the disclosed system, methods, and techniques may directly or indirectly affect one or more components or pieces of equipment associated with the example fracturing system 10, according to one or more embodiments. The fracturing system 10 includes a fracturing fluid producing apparatus 20, a fluid source 30, a solid source 40, and a pump and blender system 50. All or an applicable combination of these components of the fracturing system 10 can reside at the surface at a well site/fracturing pad where a well 60 is located.

During a fracturing job, the fracturing fluid producing apparatus 20 can access the fluid source 30 for introducing/controlling flow of a fluid, e.g. a fracturing fluid, in the fracturing system 10. While only a single fluid source 30 is shown, the fluid source 30 can include a plurality of separate fluid sources. Further, the fracturing fluid producing apparatus 20 can be omitted from the fracturing system 10. In turn, the fracturing fluid can be sourced directly from the fluid source 30 during a fracturing job instead of through the intermediary fracturing fluid producing apparatus 20.

The fracturing fluid can be an applicable fluid for forming fractures during a fracture stimulation treatment of the well 60. For example, the fracturing fluid can include water, a hydrocarbon fluid, a polymer gel, foam, air, wet gases, and/or other applicable fluids. In various embodiments, the fracturing fluid can include a concentrate to which additional fluid is added prior to use in a fracture stimulation of the well 60. In certain embodiments, the fracturing fluid can include a gel pre-cursor with fluid, e.g. liquid or substantially liquid, from fluid source 30. Accordingly, the gel pre-cursor with fluid can be mixed by the fracturing fluid producing apparatus 20 to produce a viscous fracturing fluid for forming fractures.

The solid source 40 can include a volume of one or more solids for mixture with a fluid, e.g. the fracturing fluid, to form a solid-laden fluid. The solid-laden fluid can be pumped into the well 60 as part of a solids-laden fluid stream that is used to form and stabilize fractures in the well 60 during a fracturing job. The one or more solids within the solid source 40 can include applicable solids that can be added to the fracturing fluid of the fluid source 30. Specifically, the solid source 40 can contain one or more proppants for stabilizing fractures after they are formed during a fracturing job, e.g. after the fracturing fluid flows out of the formed fractures. For example, the solid source 40 can contain sand.

The fracturing system 10 can also include additive source 70. The additive source 70 can contain/provide one or more applicable additives that can be mixed into fluid, e.g. the fracturing fluid, during a fracturing job. For example, the additive source 70 can include solid-suspension-assistance agents, gelling agents, weighting agents, and/or other optional additives to alter the properties of the fracturing fluid. The additives can be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives can function to maintain solid particle suspension in a mixture of solid particles and fracturing fluid as the mixture is pumped down the well 60 to one or more perforations.

The pump and blender system 50 functions to pump fracture fluid into the well 60. Specifically, the pump and blender system 50 can pump fracture fluid from the fluid source 30, e.g. fracture fluid that is received through the fracturing fluid producing apparatus 20, into the well 60 for forming and potentially stabilizing fractures as part of a fracture job. The pump and blender system 50 can include one or more pumps. Specifically, the pump and blender system 50 can include a plurality of pumps that operate together, e.g. concurrently, to form fractures in a subterranean formation as part of a fracturing job. The one or more pumps included in the pump and blender system 50 can be an applicable type of fluid pump. For example, the pumps in the pump and blender system 50 can include electric pumps, gas powered pumps, diesel pumps, and combination diesel and gas powered pumps.

The pump and blender system 50 can also function to receive the fracturing fluid and combine it with other components and solids. Specifically, the pump and blender system 50 can combine the fracturing fluid with volumes of solid particles, e.g. proppant, from the solid source 40 and/or additional fluid and solids from the additive source 70. In turn, the pump and blender system 50 can pump the resulting mixture down the well 60 at a sufficient pumping rate to create or enhance one or more fractures in a subterranean zone, for example, to stimulate production of fluids from the zone. While the pump and blender system 50 is described to perform both pumping and mixing of fluids and/or solid particles, in various embodiments, the pump and blender system 50 can function to just pump a fluid stream, e.g. a fracture fluid stream, down the well 60 to create or enhance one or more fractures in a subterranean zone.

The fracturing fluid producing apparatus 20, fluid source 30, and/or solid source 40 may be equipped with one or more monitoring devices (not shown). The monitoring devices can be used to control the flow of fluids, solids, and/or other compositions to the pumping and blender system 50. Such monitoring devices can effectively allow the pumping and blender system 50 to source from one, some or all of the different sources at a given time. In turn, the pumping and blender system 50 can provide just fracturing fluid into the well at some times, just solids or solid slurries at other times, and combinations of those components at yet other times.

Figure 2:
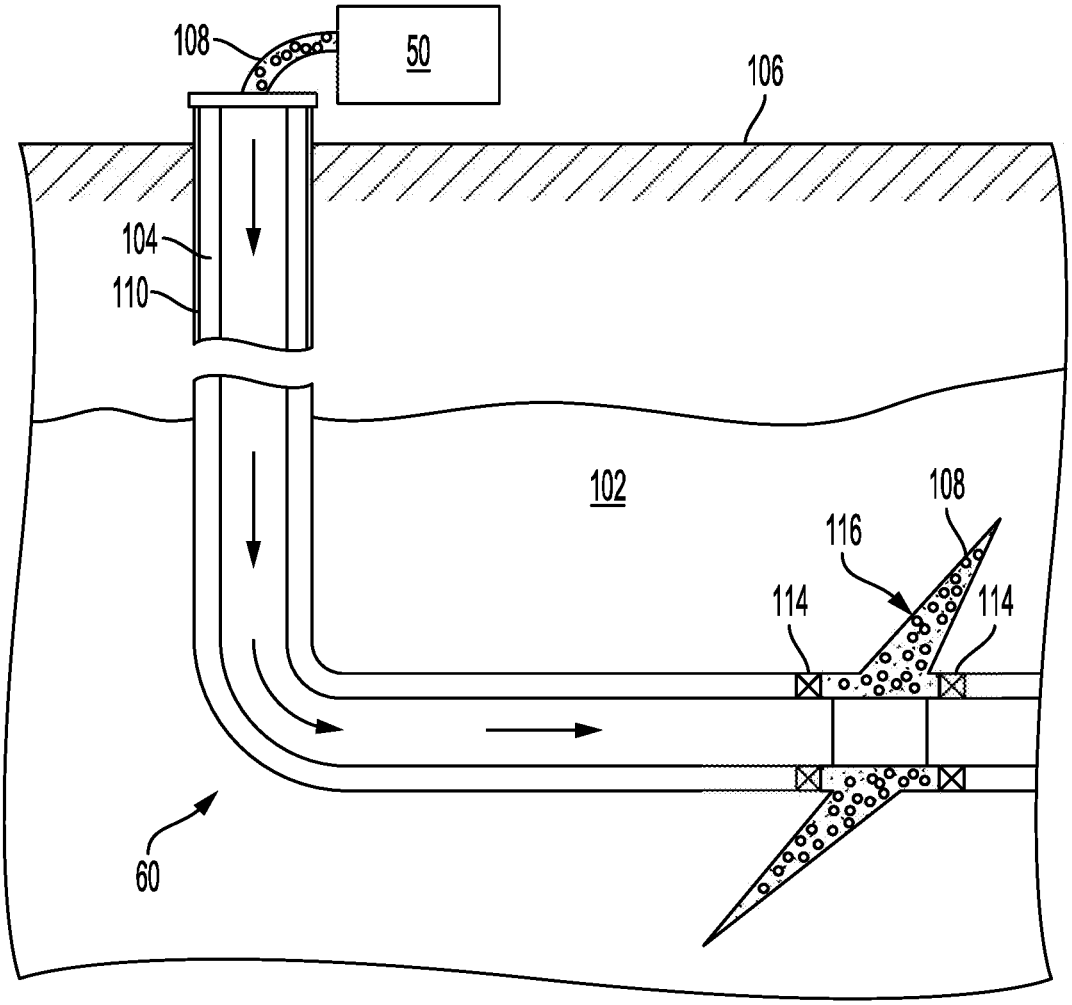
FIG. 2 shows a well during a fracturing operation in a portion of a subterranean formation of interest surrounding a wellbore, in accordance with various aspects of the subject technology.

FIG. 2 shows the well 60 during a fracturing operation in a portion of a subterranean formation of interest 102 surrounding a wellbore 104. The fracturing operation can be performed using one or an applicable combination of the components in the example fracturing system 10 shown in FIG. 1. The wellbore 104 extends from the surface 106, and the fracturing fluid 108 is applied to a portion of the subterranean formation 102 surrounding the horizontal portion of the wellbore. Although shown as vertical deviating to horizontal, the wellbore 104 may include horizontal, vertical, slant, curved, and other types of wellbore geometries and orientations, and the fracturing treatment may be applied to a subterranean zone surrounding any portion of the wellbore 104. The wellbore 104 can include a casing 110 that is cemented or otherwise secured to the wellbore wall. The wellbore 104 can be uncased or otherwise include uncased sections. Perforations can be formed in the casing 110 to allow fracturing fluids and/or other materials to flow into the subterranean formation 102. As will be discussed in greater detail below, perforations can be formed in the casing 110 using an applicable wireline-free actuation. In the example fracture operation shown in FIG. 2, a perforation is created between points 114.

The pump and blender system 50 is fluidly coupled to the wellbore 104 to pump the fracturing fluid 108, and potentially other applicable solids and solutions into the wellbore 104. When the fracturing fluid 108 is introduced into wellbore 104 it can flow through at least a portion of the wellbore 104 to the perforation, defined by points 114. The fracturing fluid 108 can be pumped at a sufficient pumping rate through at least a portion of the wellbore 104 to create one or more fractures 116 through the perforation and into the subterranean formation 102. Specifically, the fracturing fluid 108 can be pumped at a sufficient pumping rate to create a sufficient hydraulic pressure at the perforation to form the one or more fractures 116. Further, solid particles, e.g. proppant from the solid source 40, can be pumped into the wellbore 104, e.g. within the fracturing fluid 108 towards the perforation. In turn, the solid particles can enter the fractures 116 where they can remain after the fracturing fluid flows out of the wellbore. These solid particles can stabilize or otherwise "prop" the fractures 116 such that fluids can flow freely through the fractures 116.

While only two perforations at opposing sides of the wellbore 104 are shown in FIG. 2, as will be discussed in greater detail below, greater than two perforations can be formed in the wellbore 104, e.g. along the top side of the wellbore 104 or another applicable side or portion of the wellbore 104, as part of a perforation cluster. Further, multiple perforation clusters can be included in or otherwise formed during a single fracturing stage. Fractures can then be formed through the plurality of perforations in the perforation cluster as part of a fracturing stage for the perforation cluster. Specifically, fracturing fluid and solid particles can be pumped into the wellbore 104 and pass through the plurality of perforations during the fracturing stage to form and stabilize the fractures through the plurality of perforations.

Figure 3:
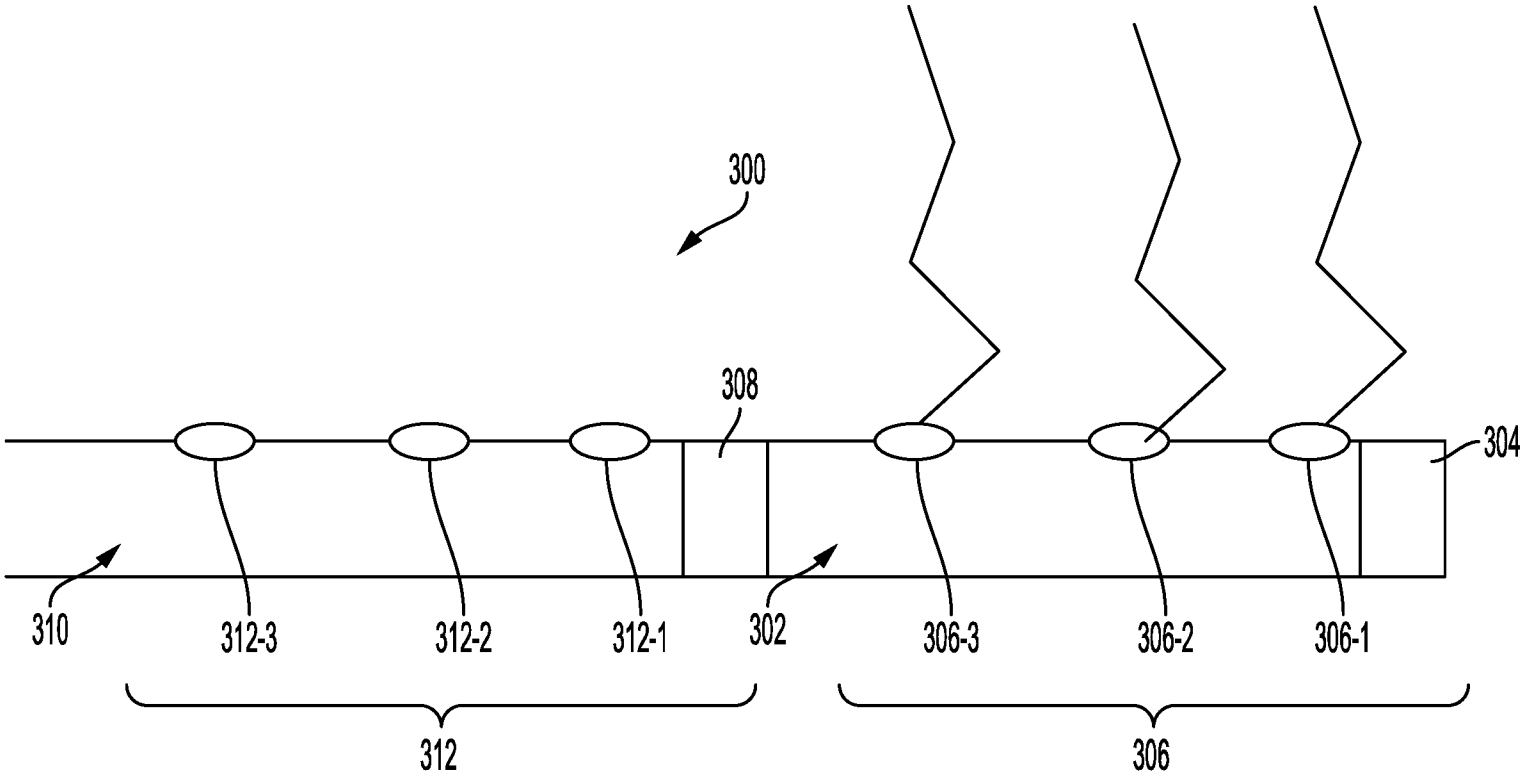
FIG. 3 shows a portion of a wellbore that is fractured using multiple fracture stages, in accordance with various aspects of the subject technology.

FIG. 3 shows a portion of a wellbore 300 that is fractured using multiple fracture stages and an isolation plug. Specifically, the wellbore 300 is fractured in multiple fracture stages using a plug-and-perf technique.

The example wellbore 300 includes a first region 302 within a portion of the wellbore 300. The first region 302 can be positioned in proximity to a terminal end of the wellbore 300. The first region 302 is formed within the wellbore 300, at least in part, by a plug 304. Specifically, the plug 304 can function to isolate the first region 302 of the wellbore 300 from another region of the wellbore 300, e.g. by preventing the flow of fluid from the first region 302 to another region of the wellbore 300. The region isolated from the first region 302 by the plug 304 can be the terminal region of the wellbore 300, e.g. the region of the wellbore 300 at the terminal end of the wellbore 300. Alternatively, the region isolated from the first region 302 by the plug 304 can be a region of the wellbore 300 that is closer to the terminal end of the wellbore 300 than the first region 302. While the first region 302 is shown in FIG. 3 to be formed, at least in part, by the plug 304, in various embodiments, the first region 302 can be formed, at least in part, by a terminal end of the wellbore 300 instead of the plug 304. Specifically, the first region 302 can be a terminal region within the wellbore 300. Such regions, e.g. the first region 302, can be formed as part of a stage in a fracturing completion process. Therefore, each region can correspond to a different fracturing stage, e.g. the fracturing stage in which the region was formed during the fracturing completion process.

The first region 302 includes a first cluster 306-1, a second cluster 306-2, and a third cluster 306-3. Each of the first cluster 306-1, the second cluster 306-2, and the third cluster 306-3 can include one or more perforations formed in the wellbore 300. For example, the first cluster 306-1 can include three perforations in the wellbore 300 and the third cluster 306-3 can include a single perforation in the wellbore 300. The first cluster 306-1, the second cluster 306-2, and the third cluster 306-3 can form a plurality of perforation clusters 306 within the first region 302 of the wellbore 300. While three clusters are shown in the plurality of perforation cluster 306, in various embodiments, the perforation clusters 306 can include fewer or more perforation clusters. As will be discussed in greater detail later, fractures can be formed and stabilized within a subterranean formation through the perforation clusters 306 within the first region 302 of the wellbore 300. Specifically, fractures can be formed and stabilized through the perforation clusters 306 within the first region 302 by pumping fracturing fluid and solid particles into the first region 302 and through the perforations of the perforation clusters 306 into the subterranean formation.

The example wellbore 300 also includes a second region 310 positioned closer to the wellhead than the first region 302. Conversely, the first region 302 is in closer proximity to a terminal end of the wellbore 300 than the second region 310. For example, the first region 302 can be a terminal region of the wellbore 300 and therefore be positioned closer to the terminal end of the wellbore 300 than the second region 310. The second region 310 is isolated from the first region 302 by a plug 308 that is positioned between the first region 302 and the second region 310. The plug 308 can fluidly isolate the second region 310 from the first region 302. As the plug 308 is positioned between the first and second regions 302 and 310, when fluid and solid particles are pumped into the second region 310, e.g. during a fracture stage, the plug 308 can prevent the fluid and solid particles from passing from the second region 310 into the first region 302.

The second region 310 includes a first perforation cluster 312-1, a second perforation cluster 312-2, and a third perforation cluster 312-3. Each of the first perforation cluster 312-1, the second perforation cluster 312-2, and the third perforation cluster 312-3 can include one or more perforations formed in the wellbore 300. The first perforation cluster 312-1, the second perforation cluster 312-2, and the third perforation cluster 312-3 can form a plurality of perforation clusters 312 within the second region 310 of the wellbore 300. While three perforation clusters are shown in the perforation clusters 312, in various embodiments, the perforation clusters 312 can include fewer or more perforation clusters. As will be discussed in greater detail later, fractures can be formed and stabilized within a subterranean formation through the perforation clusters 312 within the second region 310 of the wellbore 300. Specifically, fractures can be formed and stabilized through the perforation clusters 312 within the second region 310 by pumping fracturing fluid and solid particles into the second region 310 and through the perforations of the perforation clusters 312 into the subterranean formation.

In fracturing the wellbore 300 in multiple fracturing stages through a plug-and-perf technique, the perforation clusters 306 can be formed in the first region 302 before the second region 310 is formed. Specifically, the perforation clusters 306 can be formed before the perforation clusters 312 are formed in the second region 310. As will be discussed in greater detail later, the perforation clusters 306 can be formed using a wireline-free actuation. Once the perforation clusters 306 are formed, fracturing fluid and solid particles can be transferred through the wellbore 300 into the perforations of the perforation clusters 306 to form and stabilize fractures in the subterranean formation as part of a first fracturing stage. The fracturing fluid and solid particles can be transferred from a wellhead of the wellbore 300 to the first region 302 through the second region 310 of the wellbore 300. Specifically, the fracturing fluid and solid particles can be transferred through the second region 310 before the second region 310 is formed, and the plurality of perforation clusters 312 are formed. This can ensure, at least in part, that the fracturing fluid and solid particles flow through the second region 310 and into the subterranean formation through the perforations of the perforation clusters 306 in the first region 302.

After the fractures are formed through the perforation clusters 306-1, 306-2, and 306-3, the plug 308 can be disposed within the wellbore 300. Specifically, the plug 308 can be disposed within the wellbore 300 to form the second region 310. Then, the perforation clusters 312 can be formed, e.g. using a wireline-free actuation. Once the perforation clusters 312 are formed, fracturing fluid and solid particles can be transferred through the wellbore 300 into the perforations of the perforation clusters 312 to form and stabilize fractures in the subterranean formation as part of a second fracturing stage. The fracturing fluid and solid particles can be transferred from the wellhead of the wellbore 300 to the second region 310 while the plug 308 prevents transfer of the fluid and solid particles to the first region 302. This can effectively isolate the first region 302 until the first region 302 is accessed for production of resources, e.g. hydrocarbons. After the fractures are formed through the perforation clusters 312 in the second region 310, a plug can be positioned between the second region 310 and the wellhead, e.g. to fluidly isolate the second region 310. This process of forming perforations and perforation clusters, forming fractures during a fracture stage, followed by plugging on a region by region basis can be repeated. Specifically, this process can be repeated up the wellbore towards the wellhead until a completion plan for the wellbore 300 is finished.

Figure 4:
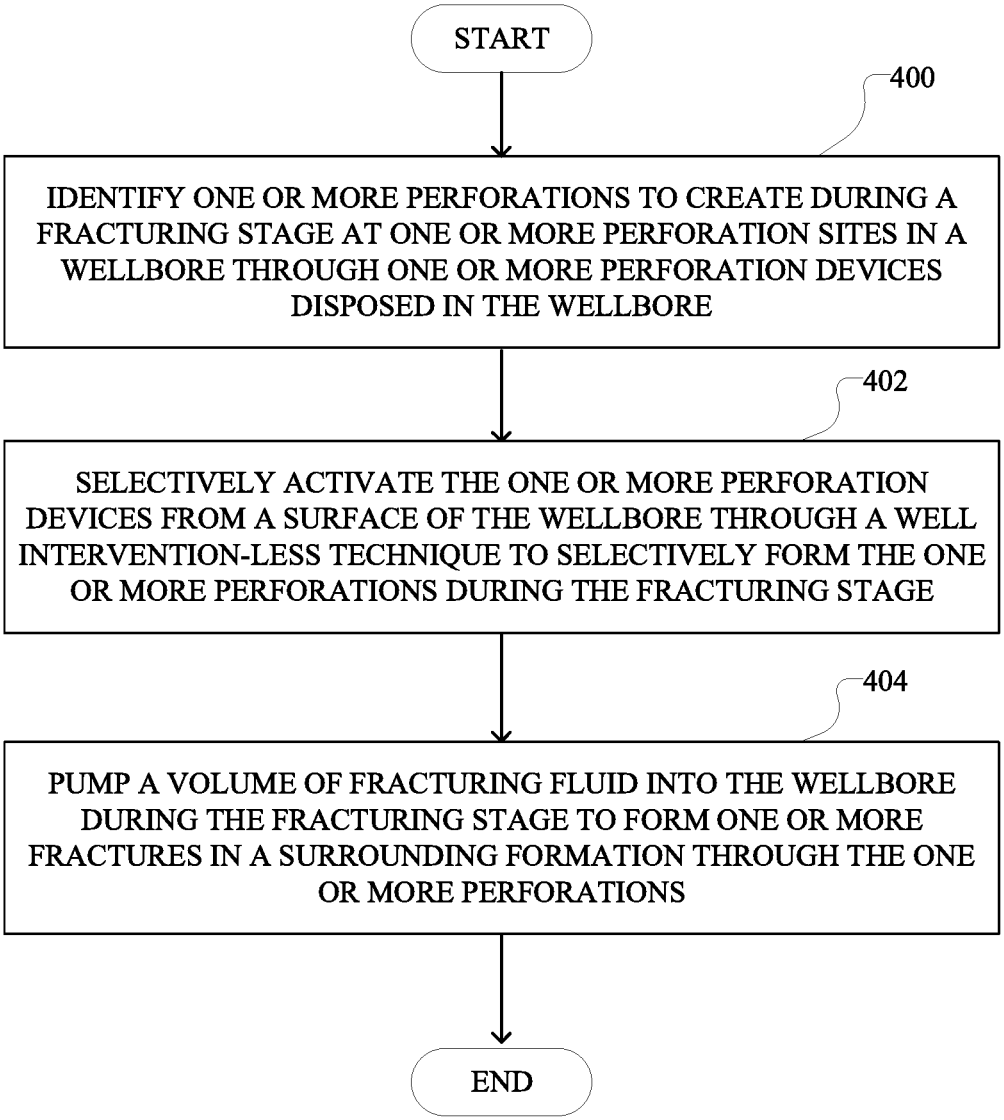
FIG. 4 illustrates a flowchart for an example method of controlling perforation formation in a wellbore from a surface of the wellbore through a well intervention-less technique, in accordance with various aspects of the subject technology.

FIG. 4 illustrates a flowchart for an example method of controlling perforation formation in a wellbore from a surface of the wellbore through a well intervention-less technique. The method shown in FIG. 4 is provided by way of example, as there are a variety of ways to carry out the method. Additionally, while the example method is illustrated with a particular order of steps, those of ordinary skill in the art will appreciate that FIG. 4 and the modules shown therein can be executed in any order and can include fewer or more modules than illustrated. Each module shown in FIG. 4 represents one or more steps, processes, methods or routines in the method.

The example method shown in the flowchart of FIG. 4 can be implemented to overcome the previously described deficiencies in controlling perforation formation during a fracturing job through a wireline technique. Specifically, the flowchart shown in FIG. 4 can be implemented to control perforation formation from a surface of a wellbore through a well intervention-less technique. For example, perforation formation devices can be activated without disposing a plug, such as the plug 308 shown in FIG. 3, through a wireline technique. As a result, resources and time that are typically used in controlling perforation formation through a wireline technique during a fracturing job can be saved.

Further, the example method shown in the flowchart of FIG. 4 can be implemented, at least in part, through applicable equipment at the surface of the wellbore. Specifically, the example method shown in the flowchart of FIG. 4 can be implemented, at least in part, through a surface control system at the surface of the wellbore. The surface control system can include applicable components and systems for controlling at least portions of a fracturing job from the surface of the wellbore. For example, the surface control system can include signal control systems for generating control signals to control perforation formation in the wellbore.

The surface control system can be implemented, at least in part, remote from the surface of the wellbore. Specifically, portions of the surface control system can be configured to control at least a portion of the fracturing job through the surface of the wellbore from a location that is remote from the wellbore. For example, the surface control system can be implemented at a remote operation center where the fracturing job can be monitored and remotely controlled through equipment and systems at the surface of the wellbore.

At step 400, one or more perforations to create during a fracturing stage of a fracturing job at one or more perforation sites in a wellbore can be identified. The one or more perforations identified at step 400 can be at an applicable location in the wellbore. Specifically, the one or more perforations identified at step 400 can be located in a horizontal portion of the wellbore in proximity to either a heel of the wellbore, e.g. the region of the wellbore that transitions from a substantially vertical portion to a substantially horizontal portion of the wellbore, or the toe of the wellbore, e.g. the end of the horizontal portion of the wellbore. Further, the one or more perforations identified at step 400 can be located in the horizontal portion of the wellbore substantially in between the heel and the toe of the wellbore.

The one or more perforations can be identified as part of identifying the one or more perforation sites to create the one or more perforations at in the wellbore. For example, perforation sites adjacent to perforations created through a previous fracturing stage can be identified as perforation sites for creating perforations during a subsequent fracturing stage.

As part of identifying the one or more perforations at step 400, one or more perforation devices associated with the one or more perforations can be identified. One or more perforation devices associated with the one or more perforations can include perforations devices for creating the identified perforations at the identified perforation sites in the wellbore. For example, a specific perforation site at which to create a perforation during a fracturing stage can be identified. Subsequently, a specific perforation device for creating the perforation at the specific perforation site can be identified.

The one or more perforations devices include applicable perforation devices for forming perforations in the wellbore. Specifically, the perforations device can include applicable perforation devices disposed in the wellbore through a non-wireline technique. More specifically, the perforation devices can include casing-integrated perforation devices. Casing-integrated perforation devices include applicable perforation devices integrated with or as part of a casing of the wellbore for creating one or more perforations through the casing of the wellbore. For example, the perforation devices can include casing-mounted charges and/or sliding sleeves integrated with the casing. In being integrated with the casing, the casing-integrated perforation devices can be integrated within a casing of a wellbore, along an interior of a casing of a wellbore, and/or along an exterior of a casing of a wellbore.

The perforation devices can be controlled through an applicable control mechanism. Specifically and as will be discussed in greater detail later, the perforation devices can be controlled from a surface of the wellbore. For example, the perforation devices can be controlled through telemetry control signals transmitted to the perforation devices from the surface of the wellbore.

The one or more perforation devices can be disposed in the wellbore before the one or more perforations are identified. Specifically, the one or more perforation devices can be disposed in the wellbore before the fracturing stage corresponding to the one or more identified perforations. For example, the one or more perforation devices can be disposed in the wellbore when the wellbore is formed, e.g. when the wellbore is stabilized with casing.

At step 402, the one or more perforation devices are selectively activated from a surface of the wellbore to selectively form the one or more perforations during the fracturing stage. Specifically, the one or more perforation devices are selectively activated through a well intervention-less technique to selectively form the one or more perforations during the fracturing stage. A well intervention-less technique, with reference to selectively activating the one or more perforation devices, includes an applicable technique for selectively activating the perforation devices without disposing a physical device down the well during a phase of selectively activating the perforation devices. A phase of selectively activating the perforation devices can include one or more times during the fracturing job during which operation(s) are performed to activate the perforation devices. For example, a well intervention-less technique for selectively activating the perforation devices can include activating the perforation devices from the surface of the wellbore without disposing a plug into the wellbore to trigger activation of the perforation devices. Further, a well intervention-less technique for selectively activating the perforation devices can include activating the perforation devices without the use of wireline or coil tubing.

The well intervention-less technique for selectively activating the one or more perforation devices can include a telemetry technique in which one or more control signals are transmitted from the surface of the wellbore to the one or more perforation devices. In turn, the one or more perforation devices can selectively activate according to the one or more control signals to create the perforations. For example, a casing-mounted perforation charge can be selectively activated through a control signal sent to the perforation charge from the surface of the wellbore.

Selectively activating the one or more perforations can include activating the one or more perforation devices on a per-device basis or a per-device group basis. Specifically, a single perforation device can be activated independently from other perforation devices, e.g. other perforation devices that are identified along with the single perforation device at step 400. For example, a group of perforation devices can be identified for creating perforations during a perforation stage. Further in the example, a single perforation device from the group of perforation devices can be selectively activated separate from other perforations in the group of perforations.

In selectively activating the one or more perforation devices on a per-device basis or a per-device group basis, control signals for controlling activation of the one or more perforation devices can be specific to a perforation device or a group of perforation devices. For example, a control signal can be unique to specific perforation device and subsequently transmitted to the specific perforation device to independently activate the perforation device. In another example, a control signal can be unique to a group of perforation devices and subsequently transmitted to the group of perforation device to independently activate the group of perforation devices from other perforation devices.

The control signals can be sent, e.g. as part of a telemetry control technique, from the surface of the wellbore to the one or more perforation devices by sending the signals along at least a portion of the wellbore to the one or more perforation devices. Further, the control signals can be sent from the surface of the wellbore to one or more perforation devices by sending the signals along at least a portion of another wellbore separate from the wellbore in which the one or more perforation devices are disposed. For example, the control signal can be sent to the one or more perforation devices at least in part through an offset wellbore.

Further, the control signals can be sent, e.g. as part of a telemetry control technique, to the one or more perforation devices through a wired connection. Specifically, the control signals can be sent to the one or more perforation devices through a wired connection formed in at least a portion of the wellbore in which the one or more perforation devices are disposed. The wired connection can be formed along an outside of the casing, within the casing, and/or along an interior of the casing. For example, the control signals can be sent to the one or more perforation devices through a wired line disposed on an outside of at least a portion of the casing of the wellbore in which the one or more perforation devices are disposed. Further, the wired connection can be formed through one or more devices disposed in the wellbore and coupled to a wired line through a wired connection. For example, the wired connection can be formed through a plurality of perforation devices that are disposed in the wellbore and coupled to each other through a wired line.

Further, the control signal can be wirelessly transferred from a wired connection to the one or more perforation devices through one or more wireless couplings between the devices and the wired connection. A wireless coupling between the devices and wired connection can include an applicable coupling for wirelessly connecting a device to a wired connection. For example, the control signals can be sent towards the one or more perforation devices through a wired line disposed on an outside of the casing of the wellbore. Further in the example, the control signals can be wirelessly transferred from the wired line to the one or more perforation devices through an inductive coupling between the wired line and the one or more perforation devices.

Additionally, the control signals can be sent, e.g. as part of a telemetry control technique, to the one or more perforation devices through a wireless connection. Specifically, the control signals can be sent to the one or more perforation devices through a wireless connection formed in/along at least a portion of the wellbore in which the one or more perforation devices are disposed. For example, the one or more perforation devices can be disposed in a horizontal portion of the wellbore and the control signals can be wirelessly transmitted to the one or more perforation devices from the heel of the wellbore. In wirelessly transmitting the control signals to the one or more perforation devices, the wireless connection can be an acoustic communication channel, and the control signals can be transmitted to the perforation devices as acoustic signals through the acoustic communication channel. Further, the wireless connection can be an electromagnetic radiation communication channel, and the control signals can be transmitted to the perforation devices as electromagnetic radiation through the electromagnetic radiation communication channel. For example, the control signals can be transmitted to the perforation devices as radio frequency signals transmitted from an offset wellbore.

A wireless communication channel in the wellbore through which control signals are sent to the one or more perforation devices can be formed through a plurality of devices disposed in the wellbore. Specifically, wireless telemetry systems can be integrated with or as part of the casing of the wellbore. Further the wireless telemetry systems can be connected to each other, e.g. in a daisy chain manner, through one or more wireless communication channels. In turn, the wireless telemetry systems can transmit control signals between each other until the control signals are ultimately transmitted from the surface to the one or more perforation devices. A wireless telemetry system can include an applicable system for either or both transmitting and receiving a signal wirelessly. For example, the wireless telemetry systems can include acoustic repeaters disposed in the wellbore that are configured to transmit acoustic control signals to the one or more perforation devices through the wellbore. Further, a wireless telemetry system can include a perforation device that is configured to either or both transmit and receive a signal wirelessly, as well as form one or more perforations in the wellbore.

Downhole diagnostics data gathered in the wellbore can be transmitted to the surface through the communication channel used to control the one or more perforation devices through a telemetry activation control technique. For example, downhole diagnostics data can be transferred from the toe of the wellbore to the surface to the wellbore through a wired connection used to transmit control signals to perforation devices at the toe of the wellbore. In another example, downhole diagnostics data can be wirelessly transferred from a horizontal portion of the wellbore to the heel of the wellbore through a wireless communication channel formed in the horizontal portion of the wellbore. As follows, the downhole diagnostics data can be transferred from the heel of the wellbore to the surface of the wellbore through a wired connection.

Downhole diagnostics data can include applicable information related to a fracturing job that is capable of being gathered in a wellbore. Specifically, downhole diagnostics data can include applicable information capable of being gathered in a wellbore during a fracturing job by one or more sensors disposed in the wellbore or in proximity to the wellbore. For example, downhole diagnostics data can include pressure at a location, e.g. a perforation or corresponding perforation site, in the wellbore. As will be discussed in greater detail later, gathered downhole diagnostics data can be used in controlling operations during the fracturing completion job.

At step 404, a volume of fracturing fluid is pumped into the wellbore during the fracturing stage to form one or more fractures in a surrounding formation through the one or more perforations. Specifically, the volume of fracturing fluid can be pumped to the one or more perforations to form and stabilize the one or more fractures through the one or more perforations as part of the fracturing stage. As follows and as will be discussed in greater detail later, another fracturing stage of the fracturing job can be performed in the wellbore.

Figure 5:
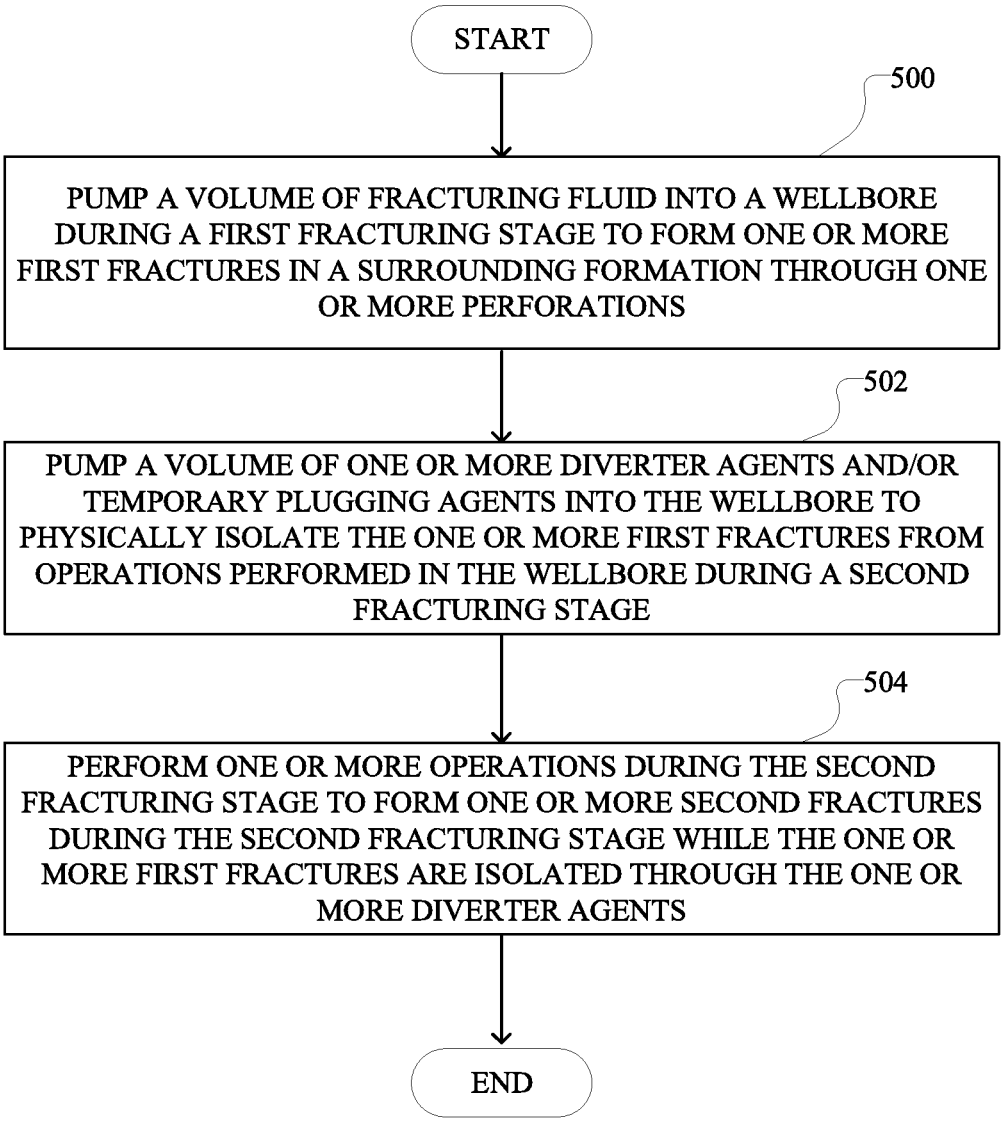
FIG. 5 illustrates a flowchart for an example method of isolating perforations through a well intervention-less technique, in accordance with various aspects of the subject technology.

FIG. 5 illustrates a flowchart for an example method of isolating perforations through a well intervention-less technique. The method shown in FIG. 5 is provided by way of example, as there are a variety of ways to carry out the method. Additionally, while the example method is illustrated with a particular order of steps, those of ordinary skill in the art will appreciate that FIG. 5 and the modules shown therein can be executed in any order and can include fewer or more modules than illustrated. Each module shown in FIG. 5 represents one or more steps, processes, methods or routines in the method.

The example method shown in the flowchart of FIG. 5 can be implemented to overcome the previously described deficiencies in plugging a wellbore during different fracturing stages of a fracturing job through a wireline technique. Specifically, the flowchart shown in FIG. 5 can be implemented to control perforation isolation from a surface of a wellbore through a well intervention-less technique. Effectively, perforation isolation can be achieved without actually disposing plugs, such as the plug 308, into a wellbore, e.g. through a wireline technique. As a result, resources and time that are typically used in controlling perforation isolation through a wireline technique during a fracturing job can be saved. Further, as physical devices, as will be discussed in greater detail later, are not disposed in the wellbore to physically isolate the perforations, the production costs and production times during the production phase of the wellbore can be conserved.

Further, the example method shown in the flowchart of FIG. 5 can be implemented, at least in part, through applicable equipment at the surface of the wellbore. Specifically, the example method shown in the flowchart of FIG. 5 can be implemented, at least in part, through a surface control system at the surface of the wellbore. The surface control system can include applicable components and systems for controlling at least portions of a fracturing job from the surface of the wellbore. For example, the surface control system can include pump control systems for controlling the pumping of solids and fluids into the wellbore during the fracturing job.

At step 500, a volume of fracturing fluid is pumped into a wellbore during a first fracturing stage to form one or more first fractures in a surrounding formation through one or more perforations. The one or more perforation can be formed during the first fracturing stage through one or more applicable techniques for forming perforations to a surrounding formation in a wellbore. Specifically, the one or more perforations can be formed during the first fracturing stage through a well intervention-less technique, such as the techniques described with respect to the flowchart 400 shown in FIG. 4. More specifically, the one or more perforations can be formed by selectively activating one or more perforation devices from the surface of the wellbore through a telemetry technique.

At step 502, a volume of one or more diverter agents or temporary plugging agents are pumped into the wellbore. The one or more diverter agents or temporary plugging agents can be pumped into the wellbore to physically isolate the one or more first fractures formed and stabilized during the first fracturing stage from operations performed in the wellbore during a second fracturing stage. Specifically, the one or more diverter agents or temporary plugging agents can be pumped into the wellbore after the one or more first fractures are formed and stabilized and before one or more perforations are created during the second fracturing stage after the first fracturing stage. In turn, the one or more diverter agents or temporary plugging agents can settle in the perforation(s) and/or the fracture(s) to seal the fracture (s), at least in part, from the wellbore. As follows, this can physically isolate the fracture(s) from operations performed in the wellbore during subsequent fracturing stages.

The diverter agent and/or temporary plugging agent can be used to effectively perform the same physical isolation functions of plugs. Accordingly, the plug-and-perf technique of forming fractures in different fracturing stages can effectively be performed without disposing one or more plugs into the wellbore. As follows, time and resources spent on disposing plugs into a wellbore as part of the plug-and-perf technique of fracture formation and stabilization can be eliminated from the fracturing job. Specifically, the time and resources used in selectively placing plugs through wireline or coil tubing techniques can be eliminated, thereby conserving both time and resources during the fracturing job.

The one or more diverter agents and temporary plugging agents can include applicable substances that are capable of being pumped into a wellbore and function to physically isolate perforations and corresponding fractures after being pumped into the wellbore. Specifically, the one or more diverter agents and temporary plugging agents can include applicable substances for filling a fracture and/or a perforation in proximity to a corresponding perforation site of the fracture. Diverter agents can include substances that selectively aggregate and divert fluid away from high flow rate areas, e.g. by at least partially plugging perforations and/or corresponding fractures, to lower flow rate areas to achieve a more uniform flow distribution. Temporary plugging agents can include substances that stop all fluid flow in a region, e.g. by completely plugging perforations and/or corresponding fractures in the region, for a period of time until some or all of the solid material in the temporary plugging agents degrades. Diverter agents and temporary plugging agents can include at least one of perforation ball sealers, degradable perforation ball sealers, particulates, degradable particulates, ceramic-based solids, mineral-based solids, fine mesh sand, and crosslinked gelled fluids. For example, a diverter agent can include poly lactic acid (PLA) particulates. In another example, a diverter agent can include chunks of crosslinked gelled fluids.

The one or more diverter agents and temporary plugging agents can include one or more substances that can be flowed back from the wellbore through an applicable technique, e.g. through coiled tubing or through flow back during normal operations performed in the wellbore. In turn, this can allow for recovery of the diverter agents and temporary plugging agents at the surface and potential reuse of the diverter agents and temporary plugging agents. Further, the one or more diverter agents and temporary plugging agents can include one or more substances that degrade, e.g. self-degrade, based on one or a combination of time, temperature, and hydraulic conditions. For example, a plugging agent can include a substance that degrades in the presence of water.

At step 504, one or more operations are performed during the second fracturing stage to form one or more second fractures during the second fracturing stage. Specifically, the one or more operations can be performed during the second fracturing stage while the one or more first fractured formed during the first fracturing stage are physically isolated from the operation(s) through the diverter agent(s)/temporary plugging agent(s). The operation(s) performed during the second fracturing stage at step 504 can include applicable operations performed during a fracturing stage of a fracturing job. Specifically, the operation(s) can include operations for forming perforations during the second fracturing stage, forming fractures through the perforations during the second fracturing stage, and stabilizing the fractures during the second fracturing stage. More specifically, the operation(s) can include forming one or more perforations during the second fracturing stage through a well intervention-less technique, such as the techniques described with respect to the flowchart 400 shown in FIG. 4.

The flowchart shown in FIG. 5 can repeated an applicable number of times to complete a fracturing job. Specifically, after the perforation(s) and the fracture(s) are formed during the second fracturing stage, a diverter agent can again be pumped into the wellbore to physically isolate the fracture(s) formed during the second fracturing stage. In turn, operations can be performed during a third fracturing stage to form perforation(s) and fracture(s) in the wellbore.

The pumping operations occurring during fracturing stages and the pumping operation of pumping diverter agents and/or temporary plugging agents can be performed in a specific sequence. Specifically, fracturing fluids can be pumped at step 500 to form the fracture(s) during the first fracturing stage. After the fracturing fluid is pumped during the first fracturing stage, the one or more diverter agent(s) and/or temporary plugging agent(s) can be pumped at step 502. After the one or more diverter agent(s) and/or temporary plugging agent(s) are pumped at step 502, then fracturing fluids can be pumped, at step 504, during the second fracturing stage. Specifically, the fracturing fluids can be pumped, at step 504, after one or more perforation(s) are formed during the second fracturing stage. The pumping stages of pumping the fracturing fluid during the first fracturing stage, pumping the one or more diverter agent(s) and/or temporary plugging agent(s) and pumping the fracturing fluid during the second fracturing stage can be performed as a continuous pumping operation. Specifically, pumping equipment at the surface can be controlled, e.g. through a surface control system, to sequentially pump the fracturing fluid during the first fracturing stage, the one or more diverter agents and/or temporary plugging agent(s), and the fracturing fluid during the second fracturing stage, as part of a continuous pumping operation.

Operations of fracturing jobs can be controlled based on downhole diagnostics data. Specifically, operations related to selectively activating the one or more perforation devices can be controlled based on downhole diagnostics data. In particular, one or more perforation devices can be selectively activated during a fracturing stage based on a progress of physically isolating fractures created during a previous fracturing stage, as indicated by downhole diagnostics data. For example, if it is determined that the fracture(s) formed at step 500 are sufficiently isolated from the wellbore, e.g. by a numerical value or within a threshold, as determined from the downhole diagnostics data, then the one or more operations can be performed during the next fracturing stage at step 504.

Moreover, the downhole diagnostics data may guide the operation to selectively activate a perforation device according to desired perforation characteristic(s). A perforation characteristic can include an applicable characteristic of a perforation or a group of perforations that can be selectively controlled during a fracturing job. For example, perforation characteristics can include perforation size, e.g. perforation diameter, perforation location amongst a group of potential perforation locations, phasing, and a number of perforations in a group of perforations. For example, downhole diagnostics data can indicate that perforations of a specific size at specific locations should be formed during a fracturing job. As follows, specific perforation devices for forming the perforations of the specific size at the specific locations can be activated based on the downhole diagnostics data.

The downhole diagnostics data can include information related to pressure at the fracturing sites and/or perforations as the diverter agent(s) and/or temporary plugging agent(s) are pumped into the wellbore at step 502. In turn, the progress of physically isolating the fractures can be identified based on the pressure at the corresponding fracturing sites included in the downhole diagnostics data. As follows, the perforation devices can be selectively activated during the second fracturing stage to form the perforations based on the progress of physically isolating the fractures, as identified from the pressure information. For example if a pressure at the perforation sites increases, e.g. with respect to a pumping pressure of the diverter agent(s) and/or temporary plugging agent(s), then it can be determined that the perforations are physically isolated through the diverter agent(s)/temporary plugging agent(s). In turn, perforation devices can be activated during a next fracturing stage based on the perforations and the fractures being physically isolated from the wellbore.

In creating perforations and isolating fractures through well intervention-less techniques, fracturing stages can be performed in different portions of the wellbore out of a typical sequence of performing fracturing stages through the plug-and-perf technique. Specifically as plugs are used to isolate and potentially control perforation formation in the standard plug-and-perf technique, fracturing stages are typically performed in sequence from the toe of the wellbore towards the heel of the wellbore. However, using the techniques described in the flowcharts in FIGS. 4 and 5, fractures can be formed and isolated during different fracturing stages in regions of the wellbore that are not physically adjacent to each other. For example, one or more fracturing stages can first be performed in proximity to the toe of the wellbore. Then, one or more fracturing stages can be performed in proximity to the heel of the wellbore. This process can be repeated as the fracturing stages move closer and closer to the center of the horizontal portion of the wellbore.

Figure 6A:
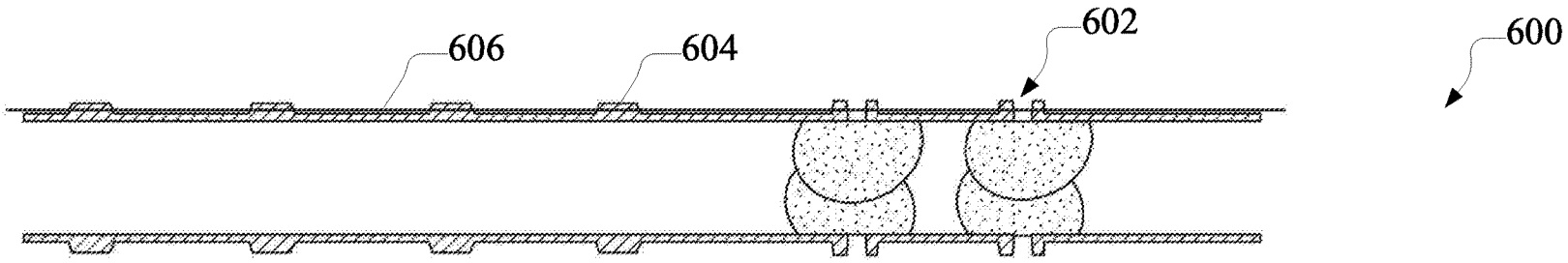
FIG. 6A shows a cross-sectional view of a portion of a wellbore in which perforation formation is controlled through wired telemetry, in accordance with various aspects of the subject technology.

FIG. 6A shows a cross-sectional view of a portion of a wellbore 600 in which perforation formation is controlled through wired telemetry. The wellbore 600 includes perforations and corresponding fractures 602 formed during a previous fracturing stage. The perforations and corresponding fractures are physically isolated through one or more diverter agents. The wellbore 600 also includes perforation devices 604 disposed in the wellbore. The perforation devices 604 are coupled to the surface of the wellbore 600 through one or more wired communication channels 606.

Figure 6B:
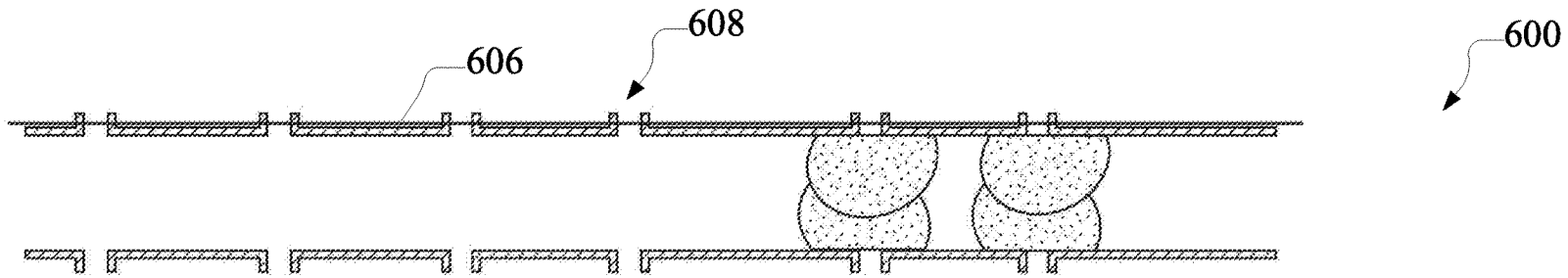
FIG. 6B shows a cross-sectional view of the portion of the wellbore with perforations formed during a fracturing stage, in accordance with various aspects of the subject technology.

FIG. 6B shows a cross-sectional view of the portion of the wellbore 600 with perforations 608 formed during a fracturing stage. Specifically, the perforations 608 with the perforation devices 604 shown in the cross-sectional view in FIG. 6A. More specifically, the perforation devices 604 are activated through one or more control signals sent to the perforation devices 604 through the one or more wired communication channels 606.

Figure 6C:
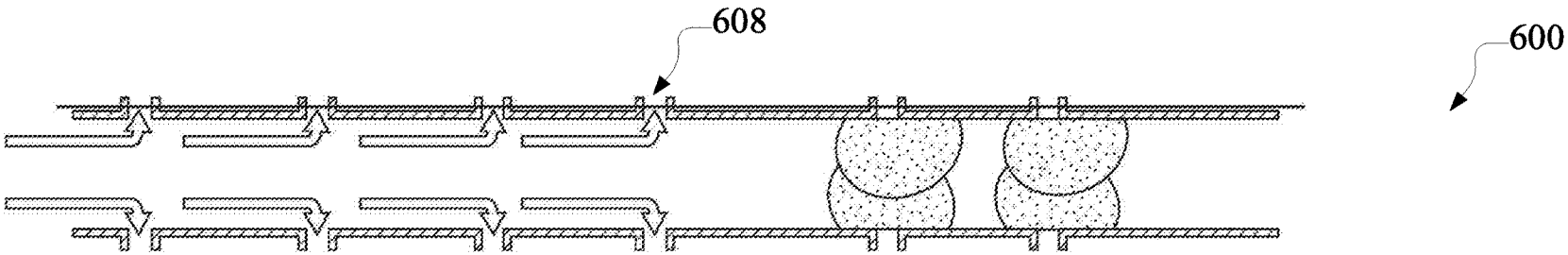
FIG. 6C shows a cross-sectional view of the portion of the wellbore during a pumping phase of the fracturing stage, in accordance with various aspects of the subject technology.

FIG. 6C shows a cross-sectional view of the portion of the wellbore 600 during a pumping phase of the fracturing stage. Specifically, a volume of fracturing fluid is pumped through the wellbore 600 and the perforations 608 to form fractures into a surrounding formation.

Figure 7A:
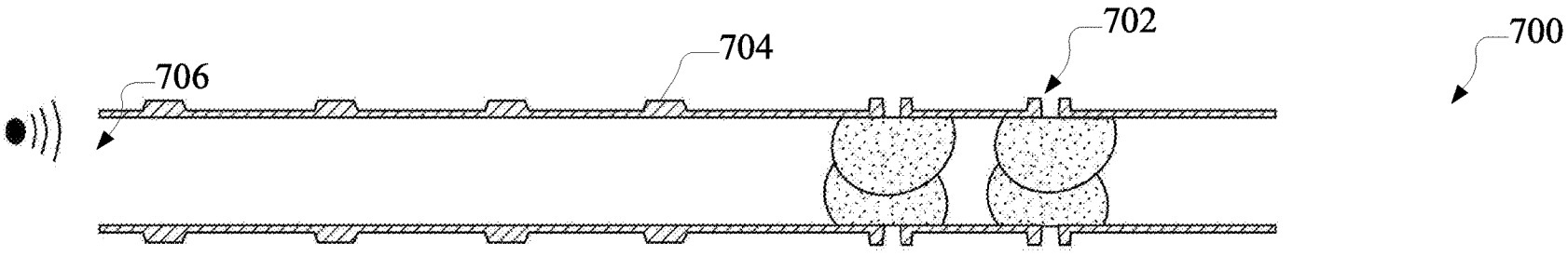
FIG. 7A shows a cross-sectional view of a portion of a wellbore in which perforation formation is controlled through acoustic telemetry, in accordance with various aspects of the subject technology.

FIG. 7A shows a cross-sectional view of a portion of a wellbore 700 in which perforation formation is controlled through acoustic telemetry. The wellbore 700 includes perforations and corresponding fractures 702 formed during a previous fracturing stage. The perforations and corresponding fractures are physically isolated through one or more diverter agents. The wellbore 700 also includes perforation devices 704 disposed in the wellbore. The perforation devices 704 can include acoustic actuators that can receive acoustic signals, and potentially transmit acoustic signals, for controlling activation of the perforation devices 704. Further, the perforation devices 704 are coupled to the surface of the wellbore 700 through one or more acoustic communication channels 706.

Figure 7B:
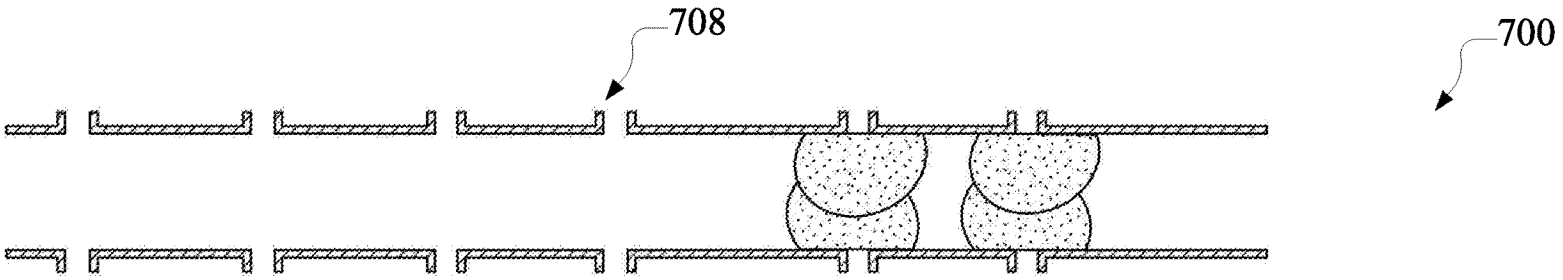
FIG. 7B shows a cross-sectional view of the portion of the wellbore with perforations formed during a fracturing stage, in accordance with various aspects of the subject technology.

FIG. 7B shows a cross-sectional view of the portion of the wellbore 700 with perforations 708 formed during a fracturing stage. Specifically, the perforations 708 with the perforation devices 704 shown in the cross-sectional view in FIG. 7A. More specifically, the perforation devices 704 are activated through one or more control signals sent to the perforation devices 704 through the one or more acoustic communication channels 706.

Figure 7C:
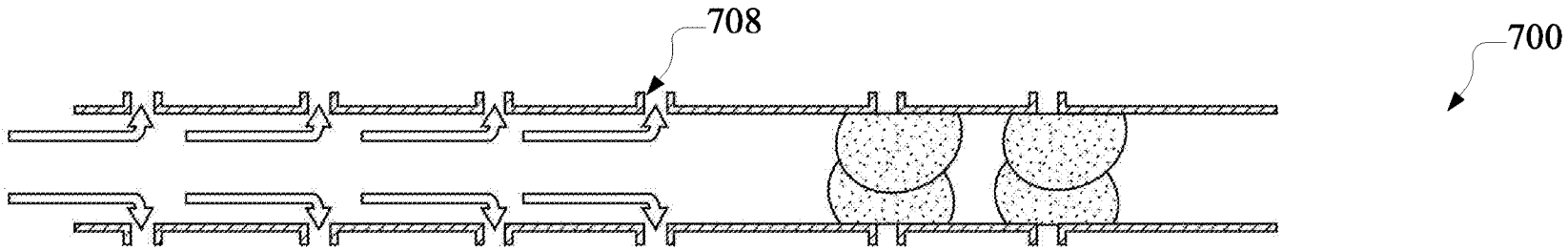
FIG. 7C shows a cross-sectional view of the portion of the wellbore during a pumping phase of the fracturing stage, in accordance with various aspects of the subject technology.

FIG. 7C shows a cross-sectional view of the portion of the wellbore 700 during a pumping phase of the fracturing stage. Specifically, a volume of fracturing fluid is pumped through the wellbore 700 and the perforations 708 to form fractures into a surrounding formation.

The methods of selectively forming perforations through a well intervention-less technique described here can be applied in solving problems associated with screen outs. A screen out occurs when a perforation becomes blocked during a stage of pumping fracturing fluid and proppant into a perforation and corresponding fracture. A screen out can occur across multiple perforations in a cluster of perforations. Specifically, a screen out can occur in a cluster of perforations from a total number of separate perforation clusters that are fractured during a fracturing stage. The current tendency in response to a screen out is to continue pumping fluid and proppant at the same flow rates and concentrations and to facilitate distribution of the fluid into the remaining perforations. However, this can lead to excessive perforation erosion, run-away fractures and/or higher treating pressures due to excessive frictional pressure drops. These outcomes may lead to frac hit (well bashing) or even early termination of the fracturing stage. To negate these impacts, one or more perforations can be selectively created through the techniques described herein as the proppant and fluid is pumped into the wellbore. Specifically, one or more perforations can be created upstream from the screen out. In turn, this can divert some of the flow of the proppant and fluid, thereby reducing perforation erosion, frictional pressure drop and the chances of a run-away fracture downstream.

The methods of pumping one or more diverter agents to the wellbore to physically isolate the one or more fractures formed during a fracturing stage can be performed based on a size of the one or more fractures. Specifically, the one or more diverter agents can be pumped into the wellbore based on the fractures in relation to one or more offset wells. For example, it can be detected that the fractures are approaching an offset wellbore, e.g. through sensors placed in the offset wellbore. In response, the one or more diverter agents can be pumped to seal the corresponding perforations of the fractures, thereby stopping growth of the fractures.

The methods of selectively forming perforations through a well intervention-less technique and pumping one or more diverter agents to physically isolate fractures can be applied to remedy fracture asymmetry. Asymmetric growth of fractures can occur due to local stress conditions or a depleted offset wellbore. In order to achieve greater fracture coverage and reduce the impact of asymmetric fracture growth, fractures can be diverted based on stresses created in the surrounding formation by fractures. Specifically, one or more first perforations can be formed and one or more first fractures can be formed through the first perforations to stress the surrounding formation. In turn, one or more second perforations can be formed and one or more second fractures can be formed in a direction substantially opposite of the first fractures. Specifically, as the first fractures stressed the formation, this can cause, at least in part, the second fractures to form away from the areas stressed by the first fractures. The first perforations and the second perforations can be adjacent to each other and formed by selectively first activating every other perforation device in a group of perforation devices and then selectively activating the remaining perforation devices in the group.

While the description has made reference to performing fracturing jobs as part of well completion activities, the techniques and systems described herein can be applied to any applicable situation where a fracturing job is performed. Specifically, the techniques and systems for performing a fracturing job, as described herein, can be applied to perform well workover activities. For example, the techniques and systems described herein can be applied in well workover activities to change a completion based on changing hydrocarbon reservoir conditions. In another example, the techniques and systems described herein can be applied in well workover activities to pull and replace a defective completion.

Figure 8:
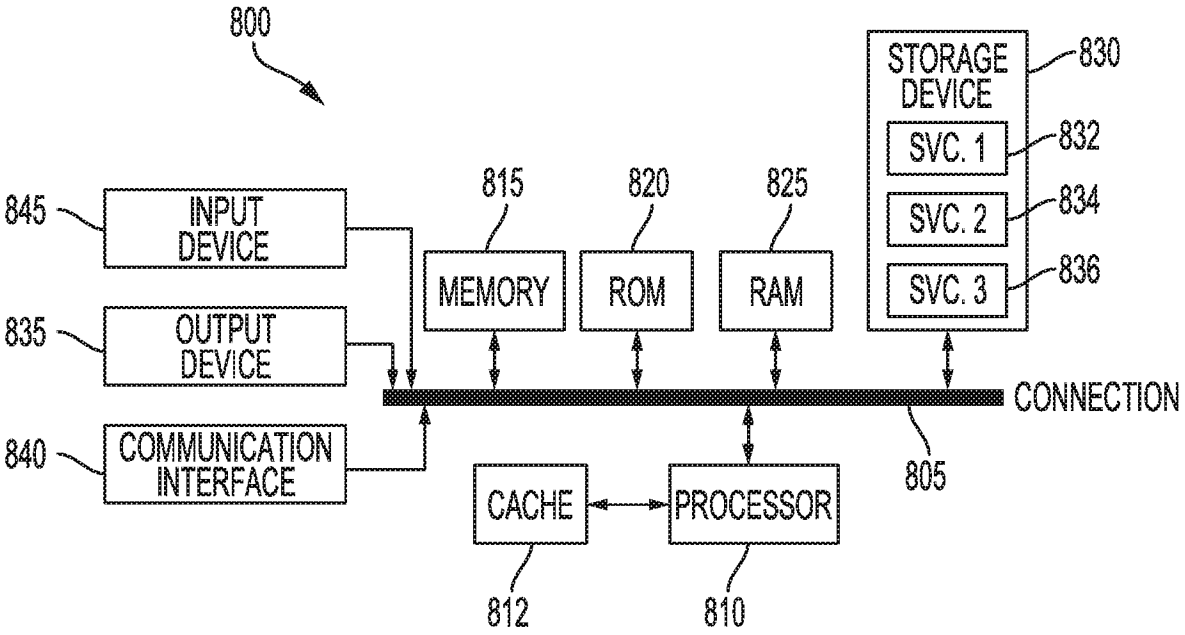
FIG. 8 illustrates an example computing device architecture which can be employed to perform various steps, methods, and techniques disclosed herein.

FIG. 8 illustrates an example computing device architecture 800 which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 8 illustrates an example computing device architecture 800 of a computing device which can implement the various technologies and techniques described herein. The components of the computing device architecture 800 are shown in electrical communication with each other using a connection 805, such as a bus. The example computing device architecture 800 includes a processing unit (CPU or processor) 810 and a computing device connection 805 that couples various computing device components including the computing device memory 815, such as read only memory (ROM) 820 and random access memory (RAM) 825, to the processor 810.

The computing device architecture 800 can include a cache of high-speed memory connected directly with, in close proximity to, or integrated as part of the processor 810. The computing device architecture 800 can copy data from the memory 815 and/or the storage device 830 to the cache 812 for quick access by the processor 810. In this way, the cache can provide a performance boost that avoids processor 810 delays while waiting for data. These and other modules can control or be configured to control the processor 810 to perform various actions. Other computing device memory 815 may be available for use as well. The memory 815 can include multiple different types of memory with different performance characteristics. The processor 810 can include any general purpose processor and a hardware or software service, such as service 1 832, service 2 834, and service 3 836 stored in storage device 830, configured to control the processor 810 as well as a special-purpose processor where software instructions are incorporated into the processor design. The processor 810 may be a self-contained system, containing multiple cores or processors, a bus, memory controller, cache, etc. A multi-core processor may be symmetric or asymmetric.

To enable user interaction with the computing device architecture 800, an input device 845 can represent any number of input mechanisms, such as a microphone for speech, a touch-sensitive screen for gesture or graphical input, keyboard, mouse, motion input, speech and so forth. An output device 835 can also be one or more of a number of output mechanisms known to those of skill in the art, such as a display, projector, television, speaker device, etc. In some instances, multimodal computing devices can enable a user to provide multiple types of input to communicate with the computing device architecture 800. The communications interface 840 can generally govern and manage the user input and computing device output. There is no restriction on operating on any particular hardware arrangement and therefore the basic features here may easily be substituted for improved hardware or firmware arrangements as they are developed.

Storage device 830 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 825, read only memory (ROM) 820, and hybrids thereof. The storage device 830 can include services 832, 834, 836 for controlling the processor 810. Other hardware or software modules are contemplated. The storage device 830 can be connected to the computing device connection 805. In one aspect, a hardware module that performs a particular function can include the software component stored in a computer-readable medium in connection with the necessary hardware components, such as the processor 810, connection 805, output device 835, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM)

such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hard-wired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the Disclosure Include:

Statement 1. A method comprising identifying one or more first perforations to create during a first fracturing stage of a fracturing job at one or more corresponding first perforation sites in a wellbore through one or more first perforation devices disposed in the wellbore. The method can also include selectively activating the one or more first perforation devices from a surface of the wellbore through a well intervention-less technique to selectively form the one or more first perforations during the first fracturing stage. Further, the method can include pumping a first volume of fracturing fluid into the wellbore during the first fracturing stage to form one or more first fractures in a surrounding formation through the one or more first perforations.

Statement 2. The method of statement 1, wherein the one or more first perforation devices include one or more casing-integrated perforation devices.

Statement 3. The method of statements 1 and 2, wherein the well intervention-less technique is a telemetry technique that includes transmitting one or more control signals from the surface of the wellbore to the one or more first perforation devices to selectively activate the one or more first perforation devices.

Statement 4. The method of statements 1 through 3, wherein the one or more control signals are transmitted from the surface to the one or more first perforation devices, at least in part, through a wired connection along at least a portion of the wellbore.

Statement 5. The method of statements 1 through 4, wherein the wired connection is formed through a wired line disposed on an outside of at least a portion of a casing of the wellbore. The method can further include transmitting the one or more control signals towards the one or more first perforation devices through the wired line. Additionally, the method can include wirelessly transmitting the one or more control signals from the wired line at the outside of the at least a portion of the casing to the one or more first perforation devices through one or more wireless couplings between the wired line and the one or more first perforation devices.

Statement 6. The method of statements 1 through 5, wherein the one or more control signals are transmitted from the surface to the one or more first perforation devices, at least in part, through a wireless connection along at least a portion of the wellbore.

Statement 7. The method of statements 1 through 6, wherein the one or more control signals are acoustic signals or electromagnetic radiation signals.

Statement 8. The method of statements 1 through 7, wherein the wireless connection is formed, at least in part, through one or more acoustic repeaters disposed along the at least the portion of the wellbore.

Statement 9. The method of statements 1 through 8, wherein a control signal of the one or more control signals is unique to a perforation device of the one or more first perforation devices and the control signal is transmitted to the perforation device to independently activate the perforation device from other perforation devices disposed in the wellbore.

Statement 10. The method of statements 1 through 9, wherein the method further comprises pumping a volume of one or more diverter agents or temporary plugging agents into the wellbore based on a completion of the one or more first fractures to physically isolate the one or more first fractures from one or more other operations performed in the wellbore during the fracturing job.

Statement 11. The method of statements 1 through 10, wherein the one or more diverter agents or temporary plugging agents are configured to physically isolate the one or more first fractures from the one or more other operations performed in the wellbore at the one or more corresponding first perforation sites in the wellbore.

Statement 12. The method of statements 1 through 11, wherein the one or more diverter agents or temporary plugging agents include one or a combination of perforation ball sealers, degradable perforation ball sealers, a volume of degradable particulates, ceramic-based solids, mineral-based solids, and crosslinked gelled fluids.

Statement 13. The method of statements 1 through 12, wherein the one or more diverter agents or temporary plugging agents comprise one or more self-degrading materials that degrade based on one or a combination of time, temperature, and hydraulic conditions.

Statement 14. The method of statements 1 through 13, wherein the method further comprises identifying one or more second perforations to create during a second fracturing stage of the fracturing job at one or more corresponding second perforation sites in the wellbore through one or more second perforation devices disposed in the wellbore. The method can also include selectively activating the one or more second perforation devices from the surface of the wellbore through the well intervention-less technique to selectively form the one or more second perforations during the second fracturing stage. Further, the method can include pumping a second volume of fracturing fluid into the wellbore during the second fracturing stage to form one or more second fractures in the surrounding formation through the one or more second perforations.

Statement 15. The method of statements 1 through 14, wherein the volume of the one or more diverter agents are pumped in between the pumping of the first volume of fracturing fluid and the second volume of fracturing fluid and the first volume of fracturing fluid, the volume of the one or more diverter agents and the second volume of fracturing fluid are sequentially pumped as part of a continuous pumping operation during the fracturing job.

Statement 16. The method of statements 1 through 15, wherein the method further comprises identifying one or more times to selectively activate the one or more second perforation devices during the second fracturing stage based on a progress of physically isolating the one or more first fractures from the one or more other operations through the volume of the one or more diverter agents. The method can also include selectively activating the one or more second perforation devices based on the one or more identified times.

Statement 17. The method of statements 1 through 16, wherein the well intervention-less technique is a telemetry technique that includes transmitting one or more control signals from the surface of the wellbore to the one or more perforation devices through one or more communication channels formed between the surface and the one or more perforation devices. The method can further include transmitting one or more signals including one or more pressure measurements at the one or more first perforation sites to the surface of the wellbore through the one or more communication channels. Additionally, the method can include identifying, at the surface of the wellbore, the progress of physically isolating the one or more first fractures from the one or more other operations based on the one or more pressure measurements included in the one or more signals.

Statement 18. The method of statements 1 through 17, wherein the method further comprises identifying one or more desired perforation characteristics from downhole diagnostics data of the wellbore gathered during the fracturing job. The method can also include identifying the one or more perforations based on the one or more desired perforation characteristics.

Statement 19. A system comprising a plurality of perforation devices disposed in a wellbore at specific perforation sites of a plurality of perforation sites a surface control system implemented, at least in part, at a surface of the wellbore. The surface control system can be configured to identify one or more perforations to create during a fracturing stage of a fracturing job at one or more corresponding perforation sites of the plurality of perforation sites in the wellbore through one or more corresponding perforation devices of the plurality of perforation devices. Further, the surface control system can be configured to selectively activate the one or more perforation devices from the surface of the wellbore through a well intervention-less technique to selectively form the one or more perforations during the fracturing stage and before a volume of fracturing fluid is pumped into the wellbore during the fracturing stage to form one or more fractures in a surrounding formation through the one or more perforations.

Statement 20. A non-transitory computer-readable storage medium having stored therein instructions which, when executed by a processor, cause the processor to perform operations comprising identifying one or more perforations to create during a fracturing stage of a fracturing job at one or more corresponding perforation sites in a wellbore through one or more perforation devices disposed in the wellbore. Further, the instructions can cause the processor to selectively activate the one or more perforation devices from a surface of the wellbore through a well intervention-less technique to selectively form the one or more perforations during the fracturing stage and before a volume of fracturing fluid is pumped into the wellbore during the fracturing stage to form one or more fractures in a surrounding formation through the one or more perforations.

What is claimed is:

1. A method comprising:

identifying one or more first perforations to create during a first fracturing stage of a fracturing job at one or more corresponding first perforation sites in a wellbore through one or more first casing-integrated perforation devices disposed in the wellbore;

selectively activating the one or more first casing-integrated perforation devices from a surface of the wellbore through a well intervention-less technique to selectively form the one or more first perforations during the first fracturing stage, wherein the well intervention-less technique includes wirelessly transmitting one or more control signals to the one or more first casing-integrated perforation devices while refraining from disposing an additional physical device down the wellbore during one or more corresponding phases of selectively activating the one or more first casing-integrated perforation devices; and pumping a first volume of fracturing fluid into the wellbore during the first fracturing stage to form one or more first fractures in a surrounding formation through the one or more first perforations.

2. The method of claim 1, wherein the one or more first casing-integrated perforation devices include a plurality of casing-integrated perforation devices.

3. The method of claim 1, wherein the well intervention-less technique is a telemetry technique that includes transmitting the one or more control signals from the surface of the wellbore to the one or more first casing-integrated perforation devices to selectively activate the one or more first casing-integrated perforation devices.

4. The method of claim 3, wherein the one or more control signals are transmitted from the surface to the one or more first casing-integrated perforation devices, at least in part, through a wired connection along at least a portion of the wellbore.

5. The method of claim 4, wherein the wired connection is formed through a wired line disposed on an outside of at least a portion of a casing of the wellbore, the method further comprising:

transmitting the one or more control signals towards the one or more first casing-integrated perforation devices through the wired line; and wirelessly transmitting the one or more control signals from the wired line at the outside of the at least a portion of the casing to the one or more first casing-integrated perforation devices through one or more wireless couplings between the wired line and the one or more first casing-integrated perforation devices.

6. The method of claim 3, wherein the one or more control signals are transmitted from the surface to the one or more first casing-integrated perforation devices, at least in part, through a wireless connection along at least a portion of the wellbore.

7. The method of claim 6, wherein the one or more control signals are acoustic signals or electromagnetic radiation signals.

8. The method of claim 7, wherein the wireless connection is formed, at least in part, through one or more acoustic repeaters disposed along the at least the portion of the wellbore.

9. The method of claim 3, wherein a control signal of the one or more control signals is unique to a perforation device of the one or more first casing-integrated perforation devices and the control signal is transmitted to the perforation device to independently activate the perforation device from other perforation devices disposed in the wellbore.

10. The method of claim 1, further comprising pumping a volume of one or more diverter agents or temporary plugging agents into the wellbore based on a completion of the one or more first fractures to physically isolate the one or more first fractures from one or more other operations performed in the wellbore during the fracturing job.

11. The method of claim 10, wherein the one or more diverter agents or temporary plugging agents are configured to physically isolate the one or more first fractures from the one or more other operations performed in the wellbore at the one or more corresponding first perforation sites in the wellbore.

12. The method of claim 10, wherein the one or more diverter agents or temporary plugging agents include one or a combination of perforation ball sealers, degradable perforation ball sealers, a volume of degradable particulates, ceramic-based solids, mineral-based solids and crosslinked gelled fluids.

13. The method of claim 10, wherein the one or more diverter agents or temporary plugging agents comprise one or more self-degrading materials that degrade based on one or a combination of time, temperature, and hydraulic conditions.

14. The method of claim 10, further comprising:

identifying one or more second perforations to create during a second fracturing stage of the fracturing job at one or more corresponding second perforation sites in the wellbore through one or more second perforation devices disposed in the wellbore;

selectively activating the one or more second perforation devices from the surface of the wellbore through the well intervention-less technique to selectively form the one or more second perforations during the second fracturing stage; and pumping a second volume of fracturing fluid into the wellbore during the second fracturing stage to form one or more second fractures in the surrounding formation through the one or more second perforations.

15. The method of claim 14, wherein the volume of the one or more diverter agents are pumped in between the pumping of the first volume of fracturing fluid and the second volume of fracturing fluid; and the first volume of fracturing fluid, the volume of the one or more diverter agents, and the second volume of fracturing fluid are sequentially pumped as part of a continuous pumping operation during the fracturing job.

16. The method of claim 14, further comprising:

identifying one or more times to selectively activate the one or more second perforation devices during the second fracturing stage based on a progress of physically isolating the one or more first fractures from the one or more other operations through the volume of the one or more diverter agents; and selectively activating the one or more second perforation devices based on the one or more identified times.

17. The method of claim 16, wherein the well intervention-less technique is a telemetry technique that includes transmitting one or more control signals from the surface of the wellbore to the one or more perforation devices through one or more communication channels formed between the surface and the one or more perforation devices, the method further comprising:

transmitting one or more signals including one or more pressure measurements at the one or more first perforation sites to the surface of the wellbore through the one or more communication channels; and identifying, at the surface of the wellbore, the progress of physically isolating the one or more first fractures from the one or more other operations based on the one or more pressure measurements included in the one or more signals.

18. The method of claim 1, further comprising:

identifying one or more desired perforation characteristics from downhole diagnostics data of the wellbore gathered during the fracturing job; and identifying the one or more perforations based on the one or more desired perforation characteristics.

19. A system comprising:

a plurality of casing-integrated perforation devices disposed in a wellbore at specific perforation sites of a plurality of perforation sites; and a surface control system implemented, at least in part, at a surface of the wellbore and configured to:

identify one or more perforations to create during a fracturing stage of a fracturing job at one or more corresponding perforation sites of the plurality of perforation sites in the wellbore through one or more corresponding perforation devices of the plurality of casing-integrated perforation devices; and selectively activate the plurality of casing-integrated perforation devices from the surface of the wellbore through a well intervention-less technique to selectively form the one or more perforations during the fracturing stage and before a volume of fracturing fluid is pumped into the wellbore during the fracturing stage to form one or more fractures in a surrounding formation through the one or more perforations, wherein the well intervention-less technique includes wirelessly transmitting one or more control signals to the one or more first casing-integrated perforation devices while refraining from disposing an additional physical device down the wellbore during one or more corresponding phases of selectively activating the one or more first casing-integrated perforation devices.

20. A non-transitory computer-readable storage medium having stored therein instructions which, when executed by one or more processors, cause the one or more processors to perform operations comprising:

identifying one or more perforations to create during a fracturing stage of a fracturing job at one or more corresponding perforation sites in a wellbore through one or more casing-integrated perforation devices disposed in the wellbore; and selectively activating the one or more casing-integrated perforation devices from a surface of the wellbore through a well intervention-less technique to selectively form the one or more perforations during the fracturing stage and before a volume of fracturing fluid is pumped into the wellbore during the fracturing stage to form one or more fractures in a surrounding formation through the one or more perforations, wherein the well intervention-less technique includes wirelessly transmitting one or more control signals to the one or more first casing-integrated while refraining from disposing an additional physical device down the wellbore during one or more corresponding phases of selectively activating the one or more first casing-integrated perforation devices.

* * * * *